United States Patent [19]

Payne

[11] Patent Number: 4,536,319

[45] **Date of Patent: * Aug. 20, 1985**

[54] COMPOSITIONS COMPRISING ALKYLPOLYSACCHARIDE DETERGENT SURFACTANT

[75] Inventor: Nicholas S. Payne, Cincinnati, Ohio

[73] Assignee: The Procter & Gamble Company, Cincinnati, Ohio

[ * ] Notice: The portion of the term of this patent subsequent to Aug. 2, 2000 has been disclaimed.

[21] Appl. No.: 538,855

[22] Filed: Oct. 4, 1983

[51] Int. Cl.[3] ..... C11D 1/72; C11D 1/831

[52] U.S. Cl. ..... 252/174.17; 252/108; 252/109; 252/117; 252/132; 252/174.25; 252/529; 252/531; 252/532; 252/539; 252/540; 252/548; 252/550; 252/551; 252/558; 252/559

[58] Field of Search ..... 252/174.17, 174.25, 252/532, 531, 558, 559, 539, 540, 550, 551, 548, 529, 108, 109, 117, 132

[56] References Cited

U.S. PATENT DOCUMENTS

| | | | |
|---|---|---|---|
| 2,049,758 | 8/1936 | Bertsch et al. | 260/210 |
| 2,390,507 | 12/1945 | Cantor | 260/210 |
| 2,671,780 | 3/1954 | Gaver et al. | 260/234 |
| 2,671,781 | 3/1954 | Gaver et al. | 260/234 |
| 2,959,500 | 11/1960 | Schlapfer et al. | 127/37 |
| 2,974,134 | 3/1961 | Pollitzer | 260/209 |
| 3,092,618 | 6/1963 | Rosen et al. | 260/209 |
| 3,219,656 | 11/1965 | Boettner | 260/210 |
| 3,314,936 | 4/1967 | Ames | 260/209 |
| 3,346,558 | 10/1967 | Roth | 260/210 |
| 3,450,690 | 6/1969 | Gibbons et al. | 260/210 |
| 3,547,878 | 12/1970 | Mansfield et al. | 252/351 |
| 3,598,865 | 8/1971 | Lew | 260/210 R |
| 3,640,998 | 2/1972 | Mansfield et al. | 260/210 R |
| 3,707,535 | 12/1972 | Lew | 260/210 R |
| 3,721,633 | 3/1973 | Ranauto | 252/527 |
| 3,737,426 | 6/1973 | Throckmorton et al. | 260/210 R |
| 3,772,269 | 11/1973 | Lew | 260/210 R |
| 3,839,318 | 10/1974 | Mansfield | 260/210 R |
| 4,011,389 | 3/1977 | Langdon | 536/4 |
| 4,154,706 | 5/1979 | Kenkare et al. | 252/547 |
| 4,187,121 | 2/1980 | Herald et al. | 134/26 |
| 4,223,129 | 9/1980 | Roth et al. | 536/4 |
| 4,240,921 | 12/1980 | Kaniecki | 252/156 |
| 4,303,556 | 12/1981 | Llendado | 252/527 |
| 4,303,557 | 12/1981 | Rose | 252/527 |
| 4,309,447 | 1/1982 | Tsutsumi et al. | 424/70 |
| 4,396,520 | 8/1983 | Payne et al. | 252/89.1 |

FOREIGN PATENT DOCUMENTS

| | | |
|---|---|---|
| 593422 | 2/1934 | Fed. Rep. of Germany . |
| 3001064 | 7/1981 | Fed. Rep. of Germany . |

OTHER PUBLICATIONS

The Journal of the American Chemical Society, vol. 60, (Sep. 1938), pp. 2076-2077, Noller et al.

Nature, vol. 197, (Mar. 16, 1963), Schram et al., Several Data Sheets, Rohm & Haas Co., Material Safety Data Sheet, Coded 6-1843; a page entitled "Manufacturing Specifications, Triton BG-10"; A Specialty Chemicals Price List, Schedule CS-429,25; a publication entitled The Qualitative and Quantitative Determination of Triton BG-10, in Bottle Washing Formulations, Coded CS-400.

The Journal of the American Oil Chemist's Society, vol. 47, #5, (May 1980), pp. 162-167, Hughes et al., "Physical and Functional Properties of Some Higher Alkyl Polyglucosides".

*Primary Examiner*—Prince E. Willis

*Attorney, Agent, or Firm*—Robert B. Aylor; Richard C. Witte; Thomas H. O'Flaherty

[57] ABSTRACT

Specific alkylpolysaccharide detergent surfactants uniquely provides structure and detergency to detergent granules prepared by drying aqueous mixtures of the granules' ingredients. Such granules can contain higher amounts of water while retaining good structure.

20 Claims, No Drawings

COMPOSITIONS COMPRISING ALKYLPOLYSACCHARIDE DETERGENT SURFACTANT

DESCRIPTION OF THE PRIOR ART

Alkylpolyglycosides which are surfactants have been disclosed in U.S. Pat. Nos. 3,598,865; 3,721,633; and 3,772,269. These patents also disclose processes for making alkylpolyglycoside surfactants and built liquid detergent compositions containing these surfactants. U.S. Pat. No. 3,219,656 discloses alkylmonoglucosides and suggests their utility as foam stabilizers for other surfactants. Various polyglycoside surfactant structures and processes for making them are disclosed in U.S. Pat. Nos. 2,974,134; 3,640,998; 3,839,318; 3,314,936; 3,346,558; 4,011,389; 4,223,129. All of the above patents are incorporated herein by reference.

SUMMARY OF THE INVENTION

This invention relates to a homogeneous granular detergent composition comprising:

(1) from about 2% to about 30%, preferably from about 6% to about 25%, most preferably from about 15% to about 25%, of alkylpolysaccharide detergent surfactant having the formula $RO(R^1O)_tZ_x$ wherein R is an alkyl, alkylphenol, hydroxyalkyl, hydroxy alkylphenol, or mixtures thereof and said alkyl groups contain from about 8 to about 18 carbon atoms, preferably from about 10 to about 14; wherein each $R^1$ contains from 2 to about 4 carbon atoms, preferably ethylene, propylene, and/or glyceryl; wherein t is from 0 to about 5, preferably from about 0 to about 2; wherein Z is a moiety derived from a reducing saccharide containing from 5 to 6 carbon atoms, preferably derived from a glucose, galactose, glucosyl, or galactosyl residue or mixtures thereof, more preferably glucose; and wherein x is from about $1\frac{1}{2}$ to about 5, preferably from about $1\frac{1}{2}$ to about $2\frac{1}{2}$, most preferably from about $1\frac{1}{2}$ to about 2;

(2) from 0% to about 30%, preferably from about 10% to about 20% of detergent cosurfactant, preferably comprising one having the formula $R(SO_3)_y(COO)_z(OSO_3)_nM_q$ wherein R has the meaning given hereinbefore; y, z and n are numbers from 0 to about 4; y+z+n is from 1 to about 3, preferably 1, M is a cationic moiety; q is selected to complete the formula, the ratio of (2):(1) being from about 1:1 to 6:1;

(3) from about 5% to about 75%, preferably from about 20% to about 50% of water-soluble neutral or alkaline salt, and (4) from about 5% to about 20% water, the free fatty alcohol content preferably being less than about 1%, preferably less than about 0.5%.

DESCRIPTION OF THE PREFERRED EMBODIMENT

The Alkylpolysaccharide Detergent Surfactant

It has surprisingly been found that the specific alkylpolysaccharide detergent surfactants of this invention not only provide excellent detergency but also, provide desirable structure to granules, especially spray dried granules, even at relatively low levels. The minimum should be about 2% to provide structure benefits. However, higher levels provide larger benefits. The level used is from about 2% to about 30%, preferably from about 6% to about 25%, most preferably from about 15% to about 25% for granule structure reasons.

These alkylpolysaccharide detergent surfactants are unique among known surfactants in providing granule structure. Previously, structure was provided primarily by alkali metal silicates and/or polymeric film formers such as those described in U.S. Pat. No. 4,379,080, Murphy, incorporated herein by reference. The alkylpolysaccharide detergent surfactants can replace, either completely, or, in part, the known structure formers.

Where one wishes to limit the amount of silicate present to prevent formation of insolubles, such as when a zeolite detergency builder is present in a spray-dried granule, the alkylpolysaccharide can be used. In such granules it is known that the silicate should be less than about 5%, preferably less than about 3%, most preferably less than about 2% and, if corrosion is not a concern, silicate should be avoided in the spray-dried granule.

The level of alkylpolysaccharide detergent surfactant is also related to the type and amount of other organic materials present. With more crystalline materials, less alkyl polysaccharide is required and with more amorphous, more liquid, materials, more alkylpolysaccharide should be used. A ratio of alkylpolysaccharide to organic cosurfactant of at least about 1:3 is preferred.

The benefits include making the granules crisp, strong, and free-flowing (non-caking). These benefits are achieved even when the granules contain a relatively high level of water. The granules can contain up to about 20% water when the granules contain the maximum amount of alkylpolysaccharide detergent surfactant. This permits the formation of granules with less evaporation of water. The alkylpolysaccharide detergent surfactant also permits the formation of stable crutcher mixes with lower water content so the granules can be prepared very efficiently.

It is essential for maximum structure benefits that the alkylpolysaccharide detergent surfactant be in contact with water for a sufficient period of time to become fully hydrated. Preferably the alkylpolysaccharide detergent surfactant is added in an aqueous medium rather than as a dry powder, to minimize the time needed in the detergent crutcher.

It is surprising that the alkylpolysaccharide detergent surfactant can be exposed to moderately high temperatures, e.g. 550° F., during the drying process without being degraded excessively. Conventional nonionic detergent surfactants cannot be spray-dried readily, as is well known. However, the small amount of water that must be removed allows the use of lower temperatures if other ingredients are not stable.

The alkylpolysaccharides are those having a hydrophobic group containing from about 8 to about 20 carbon atoms, preferably from about 10 to about 18 carbon atoms, more preferably from about 10 to about 14 carbon atoms. Preferably the hydrophobic group is an alkyl chain, most preferably saturated. The polysaccharide portion of the alkylpolysaccharide detergent surfactant is derived from reducing saccharides containing from 5 to 6 carbon atoms each. Examples of reducing saccharide moieties include, galactose, glucose, fructose, glucosyl, fructosyl and/or galactosyl moieties. Glucose is preferred. It is essential that the average polysaccharide chain average from about $1\frac{1}{2}$ to about 5, preferably from about $1\frac{1}{2}$ to about $2\frac{1}{2}$, more preferably from about $1\frac{1}{2}$ to about 2 saccharide units. Preferably the amount of alkylmonosaccharide present is from about 30% to about 60%, more preferably from about 40% to about 50% and the amount of alkyl polysaccharides having saccharide chains greater than 2 is preferably less than about 10%, more preferably less than about 5%, most preferably less than about 2%. The longer polysaccharide chains make the alkyl polysaccharide too water soluble for effective detergency, although they are still effective at preventing insoluble calcium anionic detergent surfactant formation. The saccharide moieties are normally and preferably attached to the hydrophobic group through the one position, but the hydrophobic group can be attached at, e.g., the 2-, 3-, 4- or 6-positions, thus giving, e.g., a glucose or galactose as opposed to a glucoside or a galactoside. The additional saccharide units can be attached to the previous saccharide unit's 2-, 3-, 4-, and 6-positions.

Optionally and less desirably there can be a polyalkoxide, preferably a polyethoxide chain joining the hydrophobic moiety and the polysaccharide group.

Hydrophobic groups include alkyl groups, either saturated or unsaturated, branched or unbranched, preferably straight chain saturated. The alkyl group can contain up to 3 hydroxy groups as substituents and the polyalkoxide chain can contain up to about 3, preferably 1, most preferably no alkoxide moieties.

The preferred alkylpolyglycosides have the formula $ROZ_x$ wherein R, Z and x having the meanings given hereinbefore, preferably the alkyl group contains from about 12 to about 14 carbon atoms and Z is derived from glucose. To prepare these compounds a long chain alcohol is reacted with, e.g., glucose, a short chain alkyl glucoside, etc., in the presence of an acid catalyst to form the desired glycoside (attachment at the 1-position).

Known analytical techniques can be used to determine the structures of the alkylpolysaccharide surfactants herein; for example, to determine the saccharide chain length, the amount of butyl glucoside, the free fatty alcohol content, and the level of unreacted polysaccharide. More specifically, gas or liquid chromatography can be used to determine the unreacted alcohol content and the unreacted polysaccharide content respectively. Proton nmr can be used to determine the average saccharide chain length. The point of attachment of the hydrophilic portion of the molecule to the hydrophobic portion of the molecule can be determined by $13^C$ nmr.

The alkylpolysaccharide surfactants are complex mixtures. Their components vary depending upon the nature of the starting materials and the reaction by which they are prepared. Analytical standards which are useful in calibrating instruments for analyzing the components of a particular alkylpolysaccharide surfactant can be obtained from Calbiochem Behring Co. LaJolla, Calif. These standards include those for octylglucoside (Calbiochem #494559), decylglucoside (Calbiochem #252715), and dodecylmaltoside (Calbiochem #3243555).

Preferably the amount of fatty alcohol present should be less than about 1.5%, more preferably less than about 1.0%, most preferably less than about 0.5%.

The Detergent Cosurfactants

The detergent cosurfactants can be any one or more surface active agents selected from anionic, nonionic, zwitterionic, amphoteric and cationic classes and compatible mixtures thereof. Detergent surfactants useful herein are listed in U.S. Pat. No. 3,664,961, Norris, issued May 23, 1972, and in U.S. Pat. No. 3,919,678, Laughlin et al, issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of detergent surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Water-soluble nonionic surfactants are also useful in the compositions of the invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol.

Preferred nonionics are the water-soluble and water-dispersible condensation products of aliphatic alcohols containing from 8 to 22 carbon atoms, in either straight chain or branched configuration, with from 3 to 12 moles of ethylene oxide per mole of alcohol. Particularly preferred are the condensation products of alcohols having an alkyl group containing from about 9 to 15 carbon atoms with from about 4 to 8 moles of ethylene oxide per mole of alcohol.

Semi-polar nonionic surfactants include water-soluble amine oxides containing one alkyl moiety of from about 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Preferred anionic surfactants, which are excellent detergents, are calcium sensitive, more so than anionics that are poor detergents. Suitable calcium sensitive anionic detergents include the following:

Alkylbenzene Sulfonates

One of the preferred calcium sensitive detergent cosurfactants for use in this invention is an alkylbenzene sulfonate. The alkyl group can be either saturated or unsaturated, branched or straight chain and is optionally substituted with a hydroxy group. The alkyl group contains from about 6 to about 20, preferably from about 10 to about 13 carbon atoms. Suitable alkylbenzene sulfonates include $C_{13}$ alkylbenzene sulfonates with high 2-phenyl content. The preferred alkylbenzene sulfonates contain straight alkyl chain containing from about 10 to about 13 carbon atoms.

In all of the anionic cosurfactants described herein the cation is one which renders the anionic detergent surfactant water soluble or water dispersible, e.g., a cation selected from the group consisting of sodium, potassium, ammonium, mono-, di-, or triethanolammonium, calcium or magnesium or mixtures thereof.

Soap

Other anionic detergent surfactants are fatty acid soaps and similar surfactants. The soaps can be saturated or unsaturated and can contain various substituents such as hydroxy groups and alpha-sulfonate groups. Preferably the hydrophobic portion of the soap is a straight chain saturated or unsaturated hydrocarbon. The hydrophobic portion of the soap usually contains from about 6 to about 30 carbon atoms, preferably from about 10 to about 18 carbon atoms. Short chain soaps containing from about 10 to about 14 carbon atoms are especially preferred. Another preferred soap is oleate soap which forms a calcium soap that is easily dispersed.

Alkyl Sulfates and Sulfonates

Other preferred anionic detergent cosurfactants include alkyl sulfates and sulfonates derived from fatty alcohols, hydrocarbons, olefins, etc. These detergent surfactants typically have an alkylhydrophobic portion containing from about 6 to about 30 carbon atoms, preferably from about 10 to about 18 carbon atoms and a sulfate or sulfonate group. Suitable examples include $C_{14-15}$ alkyl sulfates, coconut alkyl sulfates, tallow alkyl sulfates, $C_{14-18}$ olefin sulfonates, $C_{14-15}$ paraffin sulfonates, etc. Sulfates of lightly ethoxylated long chain fatty alcohols are also useful.

In general any anionic detergent surfactant which tends to form an insoluble compound with magnesium or calcium is useful herein.

For detergency, the ratio of the alkyl polysaccharide to these preferred, calcium-sensitive anionic cosurfactants should be at least about 1:1, preferably from about 2:1 to about 6:1, most preferably from about 2:1 to about 4:1. The total of the two surfactants should be from about 8% to about 40%, preferably from about 10% to about 30%, most preferably from about 15% to about 25%.

The mixture of the alkyl polysaccharide and these preferred calcium sensitive anionic cosurfactants provide superior performance, especially under high hardness conditions, low usage conditions, or in cool water.

The level of detergent cosurfactant that can be employed is from 0% to about 30%, preferably from about 10% to about 20% of the total composition.

Water-Soluble Neutral or Alkaline Salt

The granular detergents of the present invention additionally contain from about 5% to about 75%, preferably from about 10% to about 60%, and more preferably from about 20% to about 50%, by weight of a water-soluble neutral or alkaline salt. The neutral or alkaline salt has a pH in solution of seven or greater, and can be either organic or inorganic in nature. The salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt herein.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above. However, as previously described, the present compositions contain less than about 3%, preferably less than about 2%, by weight of silicate materials and less than about 10%, preferably less than about 5%, by weight of phosphate materials. Most preferably, the compositions are substantially free of phosphates.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581, 3,213,030; 3,422,021; 3,422,137; 3,400,176 and 3,400,148, incorporated herein by reference.

Examples of non-phosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Nonphosphate detergent compositions are preferred.

Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Highly preferred polycarboxylate builders herein are set forth in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other useful builders herein are sodium and potassium carboxymethyloxymalonate, carboxymethyloxysuccinate, cis-cyclohexanehexacarboxylate, cis-cyclopentanetetracarboxylate phloroglucionol trisulfonate, and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield, et al, and U.S. Pat. No. 4,246,495, issued Mar. 27, 1970 to Crutchfield, et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Other detergency builder materials useful herein are the "seeded builder" compositions disclosed in Belgian Pat. No. 798,856, issued Oct. 29, 1973, incorporated herein by reference. Specific examples of such seeded builder mixtures are: 3:1 wt. mixtures of sodium carbonate and calcium carbonate having 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

Other detergent builder materials can be present including insoluble aluminosilicates, which are a particularly preferred embodiment. They are used at a level of from about 5% to about 55%, preferably from about 10% to about 30%. Such aluminosilicates have the formula $$Na_z[(AlO_2)_z \cdot (SiO_2)_y] \cdot xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2 \cdot ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallons/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_3$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[AlO_2)_{12}(SiO_2)_{12}].xH_2O$$

wherein x is from about 20 to about 30, especially about 27.

Additional Ingredients

In detergent compositions the compositions can contain any of the well known ingredients including minor amounts of other surfactants, detergency builders, soil suspending agents, brighteners, abrasives, dyes, fabric conditioning agents, hair conditioning agents, hydrotropes, solvents, fillers, etc. Suitable ingredients are disclosed in U.S. Pat. Nos. 4,166,039—Wise; 4,157,978—Llenado; 4,056,481—Tate; 4,049,586—Collier; 4,035,257—Cherney; 4,019,998—Benson et al; 4,000,080—Bartolotta et al; and 3,983,078—Collins, incorporated herein by reference. Listings of suitable additional ingredients, including low levels of other surfactants can be found in U.S. Pat. Nos. 4,089,945; 3,987,161; and 3,962,418, incorporated herein by reference.

Preferred additives are conventional soil suspending and anti-redeposition aids.

The compositions of this invention are prepared by mixing at least the alkylpolysaccharide detergent surfactant, the water-soluble neutral or alkaline salt and water, preferably by mixing all of the ingredients which are not heat sensitive, and then drying by conventional means, preferably by spray-drying.

All percentages, parts, and ratios used herein are by weight unless otherwise specified.

The following nonlimiting examples illustrate the compositions of the present invention.

EXAMPLE I

The following is a spray-dried detergent granule:

| | % | Range |
|---|---|---|
| $C_{12-14}$ $G_{1.7}$* | 12 | 10–15 |
| Sodium $C_{14-15}$ alkylsulfate | 4 | 3–5 |
| Sodium tripolyphosphate | 35 | 25–50 |
| Sodium carbonate | 20 | 10–30 |
| Sodium silicate (1.6r) | 6 | 6 |
| Polyethylene glycol | 1 | 0–2 |
| Water | 15 | 12–20 |
| Sodium sulfate | balance | balance |

*An alkylpolysaccharide detergent surfactant wherein the alkyl contains from 12 to 14 carbon atoms and averaging about 1.7 glycoside units, which are derived from glucose, per molecule.

These granules have good physical properties and are effective detergents, and hold more moisture than do granules made without $C_{12-14}$ $G_{1.7}$. Other surfactants and detergency builders described hereinbefore can be substituted for the alkyl sulfate, sodium tripolyphosphate, etc. with substantially equivalent results in that the granules have improved physical properties as compared to similar products prepared with conventional nonionic detergent surfactants.

EXAMPLE II

| | % | Range |
|---|---|---|
| $C_{12-14}$ $G_{1.7}$ | 6 | 4–8 |
| Na $C_{14-15}$ alkysulfate | 9 | 7–11 |
| Na $C_{13}$ linear alkylbenzene sulfonate | 9 | 7–11 |
| Hydrated sodium Zeolite A (1–3μ) | 25 | 20–30 |
| Water | 4 | 3–8 |
| Na silicate (1.6r) | 1 | 0–2 |
| $Na_2SO_4$ | balance | balance |

Unlike granules prepared with conventional ethoxylated nonionic detergent surfactants, no special processing steps or aids are required for preparing such granules.

EXAMPLE III

| | % | Range |
|---|---|---|
| $C_{12-14}$ $G_{1.7}$ | 6 | 4–8 |
| Na $C_{14-15}$ alkylsulfate | 9 | 7–11 |
| $Na_2CO_3$ | 20 | 10–30 |
| Hydrated sodium Zeolite A (1–3μ) | 25 | 20–40 |
| Water | 15 | 12–20 |
| Na silicate (1.6r) | 1 | 0–2 |
| $Na_2SO_4$ | balance | balance |

These granules have good physical properties and are effective detergents as compared to granules without the $C_{12-14}$ $G_{1.7}$ which are sticky.

What is claimed is:

1. A homogeneous granular detergent composition comprising:
   (1) from about 2% to about 30% of alkylpolysaccharide detergent surfactant having the formula $RO(R^1O)_tZ_x$ wherein R is an alkyl, alkylphenol, hydroxyalkyl, hydroxy alkylphenol, or mixtures thereof, and said alkyl groups contain from about 8 to about 18 carbon atoms; wherein each $R^1$ contains from 2 to about 4 carbon atoms; wherein t is from 0 to about 5; wherein Z is a moiety derived from a reducing saccharide containing from 5 to 6 carbon atoms; and wherein x is from about $1\frac{1}{2}$ to about 5;
   (2) from 0% to about 30% of detergent cosurfactant;
   (3) from about 10% to about 75% of water-soluble neutral or alkaline salt; and
   (4) from about 5% to about 20% water.

2. The composition of claim 1 wherein R contains from about 10 to about 14 carbon atoms, t is 0, and x is from about $1\frac{1}{2}$ to about $2\frac{1}{2}$.

3. The composition of claim 2 containing from about 6% to about 25% of (1).

4. The composition of claim 2 wherein said detergent cosurfactant is calcium sensitive anionic detergent cosurfactant having the formula $R(SO_3)_y(COO)_z(OSO_3)_nM_q$ wherein R has the meaning given hereinbefore; y, z and n are numbers from 0 to about 4; y+z+n is from 1 to about 3, M is a cationic moiety selected from the group consisting of sodium, potassium, ammonium, ethanolammonium, diethanolammonium, triethanolammonium, calcium, magnesium and mixtures thereof; and q is selected to complete the formula, the ratio of (2) to (1) being from about 1:1 to about 6:1.

5. The composition of claim 4 containing from about 10% to about 20% of (2) and (2) is selected from the group consisting of alkylbenzene sulfonates in which the alkyl contains from about 6 to about 20 carbon atoms, alkyl sulfates containing from about 6 to about 30 carbon atoms, alkyl sulfonates containing from about 6 to about 30 carbon atoms, fatty acid soaps containing from about 6 to about 30 carbon atoms, and mixtures thereof.

6. The composition of claim 5 wherein the ratio of (1) to (2) is greater than about 1:3.

7. The composition of claim 2 wherein Z is selected from the group consisting of glucose, galactose, glucosyl, and galactosyl residues and mixtures thereof.

8. The composition of claim 7 wherein Z is derived from glucose.

9. The composition of claim 1 containing from about 5% to about 55% of insoluble aluminosilicate detergency builder.

10. The composition of claim 9 containing from about 10% to about 30% of said insoluble aluminosilicate detergency builder which is hydrated sodium Zeolite A.

11. The composition of claim 10 containing less than about 3% alkaline metal silicate.

12. The composition of claim 11 containing less than about 2% of said silicate.

13. The composition of claim 12 which contains essentially no phosphate materials.

14. The composition of claim 1 containing from about 20% to about 50% of (3).

15. The composition of claim 14 wherein R contains from about 10 to about 14 carbon atoms, t is 0, and x is from about $1\frac{1}{2}$ to about $2\frac{1}{2}$.

16. The composition of claim 1 prepared by preparing an aqueous slurry of the detergent compositions ingredients minus any heat-sensitive detergent composition components and drying said slurry to form said detergent composition.

17. The composition of claim 16 which comprises (1), (3), and (4).

18. The composition of claim 17 which is prepared by spray-drying.

19. The composition of claim 16 which is prepared by spray-drying after (1) is fully hydrated.

20. The composition of claim 19 wherein in (1) R contains from about 10 to about 14 carbon atoms, t is 0, and x is from about $1\frac{1}{2}$ to about $2\frac{1}{2}$; containing from about 5% to about 55% of an insoluble aluminosilicate detergency builder; and containing from about 20% to about 50% of (3).

* * * * *